US007621464B2

(12) United States Patent
Smith et al.

(10) Patent No.: US 7,621,464 B2
(45) Date of Patent: Nov. 24, 2009

(54) VARIABLE VELOCITY SPRINKLER TRANSMISSION

(75) Inventors: Flynt Leroy Smith, Saint David, AZ (US); Bandar Hussain Alumran, Clifton Park, NY (US); Mary Margaret Boice, Tucson, AZ (US); Marianne Goble, Tucson, AZ (US); Daniel S. Gabrys, Flagstaff, AZ (US); Suzanne Lee Singer, Berkeley, CA (US)

(73) Assignee: Rain Bird Corporation, Azusa, CA (US)

( * ) Notice: Subject to any disclaimer, the term of this patent is extended or adjusted under 35 U.S.C. 154(b) by 267 days.

(21) Appl. No.: 11/610,883

(22) Filed: Dec. 14, 2006

(65) Prior Publication Data

US 2008/0142618 A1 Jun. 19, 2008

(51) Int. Cl.
*B05B 3/04* (2006.01)

(52) U.S. Cl. ..... 239/240; 239/263.3; 239/263; 239/203; 239/204

(58) Field of Classification Search ..... 239/263, 239/263.3, 240, 237, 210, 204, 203
See application file for complete search history.

(56) References Cited

U.S. PATENT DOCUMENTS

| | | | | | |
|---|---|---|---|---|---|
| 3,383,047 | A * | 5/1968 | Hauser | 239/206 |
| 3,854,664 | A * | 12/1974 | Hunter | 239/206 |
| 5,009,368 | A * | 4/1991 | Streck et al. | 239/70 |
| 5,375,768 | A * | 12/1994 | Clark | 239/210 |
| 5,562,247 | A * | 10/1996 | Roman | 239/240 |
| 5,695,122 | A * | 12/1997 | Messinger | 239/240 |
| 5,695,123 | A | 12/1997 | Le | |
| 5,720,435 | A * | 2/1998 | Hunter | 239/204 |
| 5,758,827 | A | 6/1998 | Van Le et al. | |
| 6,348,022 | B1 * | 2/2002 | Jin | 475/342 |
| 6,732,950 | B2 | 5/2004 | Ingham, Jr. et al. | |
| 7,156,322 | B1 * | 1/2007 | Heitzman | 239/240 |
| 2005/0194465 | A1 * | 9/2005 | Wang | 239/263 |

* cited by examiner

*Primary Examiner*—Len Tran
*Assistant Examiner*—Trevor E McGraw
(74) *Attorney, Agent, or Firm*—Fitch, Even, Tabin & Flannery

(57) ABSTRACT

A sprinkler having a water-driven drive mechanism or motor for rotating a sprinkler head is disclosed where the drive mechanism converts a constant input rate into a variable rate to reduce tailing from overly-rapid rotation and to promote full develop of water stream discharge profile. The drive mechanism includes continuously engaged members including one or more planet gears each having an offset or eccentrically positioned engagement portion for driving a second gear member. As the planet gear rotates, the movement of the engagement portion has a radial component relative to the second gear, and the rotational velocity of the second gear is related to the radial position of the engagement portion.

14 Claims, 10 Drawing Sheets

VARIABLE VELOCITY SPRINKLER TRANSMISSION

FIELD OF THE INVENTION

The invention relates to a rotating sprinkler and, in particular, to a rotating sprinkler with a variable rate of rotation.

BACKGROUND OF THE INVENTION

Currently, there are a number of systems known utilizing a variable rate moving sprinkler head directing one or more streams away from the sprinkler outlets or nozzles. For instance, a common type of yard sprinkler is referred to as an oscillating wave lawn sprinkler and includes a generally horizontally oriented and upwardly curved tube with a plurality of holes or nozzles along a top portion of the tube for discharging water. When the sprinkler is activated, the tube is rotated in an oscillating manner while the water is emitted in a wave-like pattern. As the tube is rotated, the emitted water streams from the nozzles moves over a pattern of ground to either side of the sprinkler. The tube element is rotated in a first direction, slows as it reaches a limit, pauses at the limit, and then is counter-rotated in a second direction opposite the first direction. In this manner, this type of sprinkler is referred to as a reversing sprinkler and, hence, a variable rate or velocity sprinkler.

Such a form of intermittent sprinkler utilizes an irregularly-shaped cam member. The rotating cam member is typically heart-shaped, for instance, so as to have a rounded portion forming two lobes divided by a cleft. An engagement member of the drive mechanism rides against the rotating cam member so that a first angular velocity, generally constant, is produced when the engagement member follows the rounded portion of the heart-shaped cam member, and so that the angular velocity approaches zero when the engagement member approaches the cleft. The sprinkler reverses once it passes beyond the cleft. Accordingly, the sprinkler pauses at the same areas at the limit of the sprinkler travel, and the design suffers from over-watering of these areas without reducing the tailing effect throughout the cycle.

With the above-described oscillating or reversing sprinkler, a greatest throw distance is only achieved at the limits of the movement. A greater amount of water is deposited at these limits, in part due to the fact that the sprinkler slows, stops, and reverses, therefore spending a disproportionate time watering an area reached by the greatest throw distance and the area adjacent thereto until the sprinkler reaches its normal rate of movement.

A stationary sprinkler will produce the maximum emission or throw distance for a water stream emitted therefrom. That is, the throw distance is based on a number of variables, including the rate of rotation. If the sprinkler is stationary and the rate of rotation is zero, the throw distance is based on the characteristics of a flow path through the sprinkler, and water pressure, among others. Assuming all these variables are held constant, other than rate of rotation, the stationary sprinkler produces the greatest throw distance. To be more precise, the water stream develops a profile when emitted, and the distance any particular droplet of water is thrown is related to the exit velocity at the nozzle, to force from subsequent droplets following the same path, and to cohesive forces between water droplets. With a stationary sprinkler, each droplet of a water stream is being driven by each successive water droplet, and each preceding water droplet reduces the air resistance experienced by the subsequent droplet.

When the sprinkler is rotating, each water droplet is emitted at a position somewhat offset from the preceding and succeeding droplets. Accordingly, a first water droplet does not receive as great a push from a subsequent water droplet, nor does it benefit from reduced air resistance. The faster the rotational velocity, the greater the offset between adjacent water droplets, the less each droplet is able to assist the throw distance of the other droplets. Accordingly, this interaction causes a "tailing" effect, and the faster the rotational velocity is, the greater the tailing effect. The result is that the water stream profile is not able to sufficiently develop for a desirable throw distance, and a tailing water stream is discharged an undesirable distance from the moving sprinkler head.

Rotating sprinklers have been employed to make the distribution from a moving sprinkler more even. A rotating sprinkler utilizes one or more nozzles discharging water in a generally radially direction, preferably above horizontal, to throw water a distance from the sprinkler to cover an area therearound. With the above-discussed oscillating sprinkler, the water streams repeatedly discharge water to the greatest distance at the limit of the oscillation, and the area between the greatest distance is watered during the counter-rotation by the sprinkler. With a rotating sprinkler, the water stream is generally emitted a particular throw distance and would not ordinarily provide significant water to the area short of this throw distance.

Various designs have been created for providing water at a varying water distances. For instance, the sprinkler may have a plurality of nozzles emitting water at various trajectories or pressures. Alternatively, the nozzle geometry may be structured to distribute water in a pattern other than a stream.

Other sprinkler designs have utilized an intermittent motion to produce a varying rotational rate. A typical rotating sprinkler utilizes a drive mechanism that generally converts force from the water flow through the sprinkler into high velocity rotation in a turbine, for instance. The turbine is then mounted on an axle for driving a gear reduction mechanism for reducing the velocity into high torque. The drive mechanism then cooperates to rotate a portion of the sprinkler.

An example of a rotating sprinkler having an intermittent motion is U.S. Pat. No. 5,758,827, to Van Le et al., which utilizes cooperating gears of the gear reduction mechanism with an irregular gear tooth pattern. For instance, one embodiment has a first gear with a single tooth such that the tooth engages with a second gear for a short period, and then disengages for a longer period of time. During the time the single tooth is disengaged, the second gear is generally stationary, and the water stream profile is allowed to more fully develop. The single tooth first gear then re-engages to effect a short motion of the second gear, whereupon the first gear disengages.

It should be noted that such an intermittent sprinkler generally has two speeds, namely moving and stationary. That is, the sprinkler rotates at a particular speed when engaged, save for inertial effects, and then does not rotate when disengaged. In addition, there is an impulse force transmitted through the sprinkler and its mechanisms, as well as to the water flow, that causes stresses and pressure fluctuations as the turbine and gear mechanism is disengaged and re-engaged. Furthermore, the sprinkler tends to spend a period of time delivering water to a particular area, then is quickly rotated to deliver water to a subsequent area. Consequently, the sprinkler tends to localize the distribution of water in areas. This is exacerbated by the fact that such a sprinkler often waters the exact same locations on each full rotation.

Accordingly, there has been a need for an improved rotating sprinkler having a varying rate or velocity that provides improved water distribution.

DETAILED DESCRIPTION OF THE PREFERRED EMBODIMENT

Figure 1:
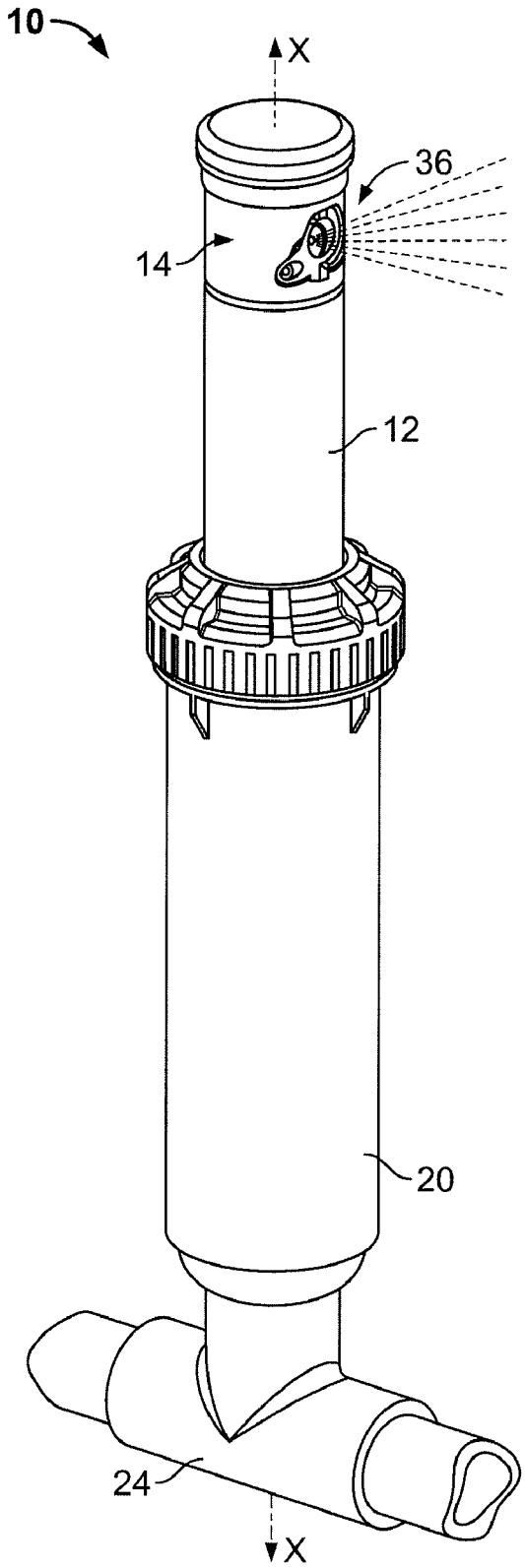
FIG. 1 is a perspective view of a sprinkler having a movable housing including a head portion rotated by a drive mechanism driven by water through a turbine.
Figure 2:
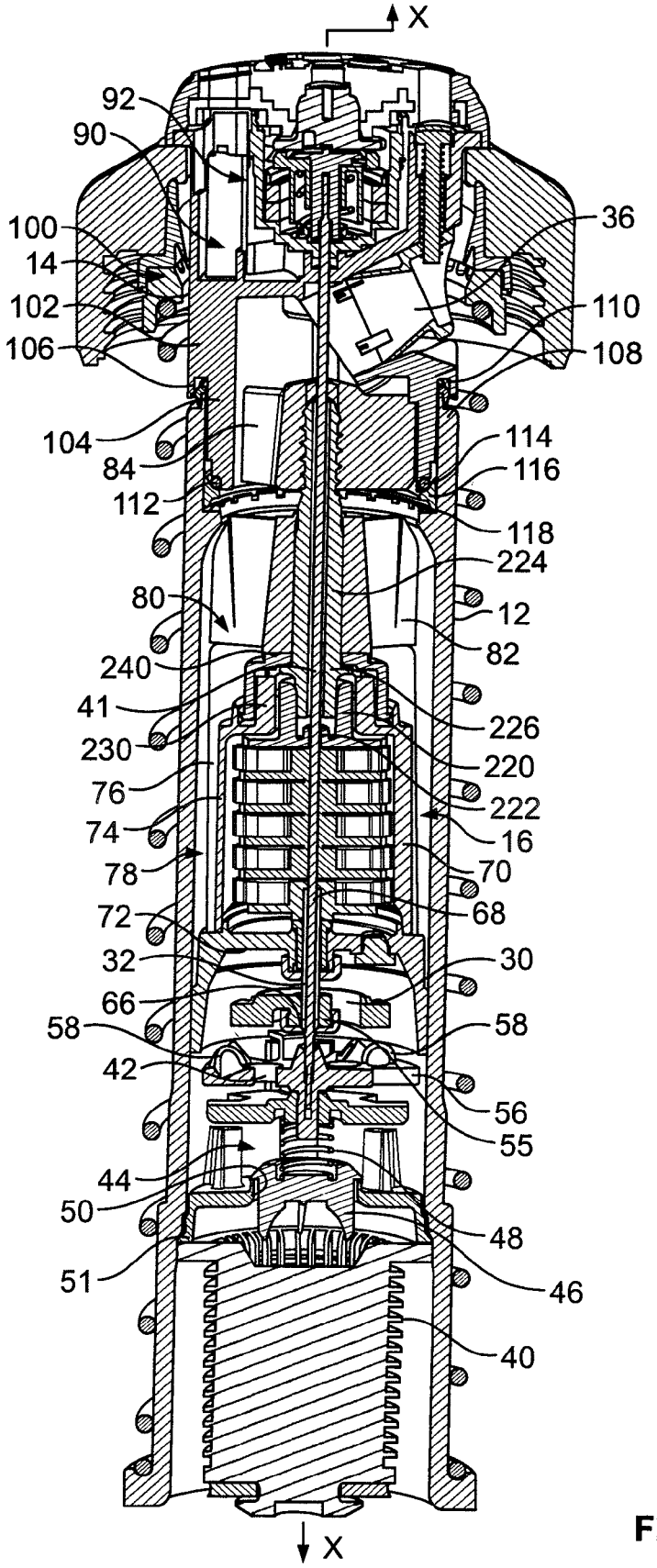
FIG. 2 is a cross-sectional view of the movable housing of FIG. 1 showing the turbine and drive mechanism for rotating the head portion.
Figure 4:
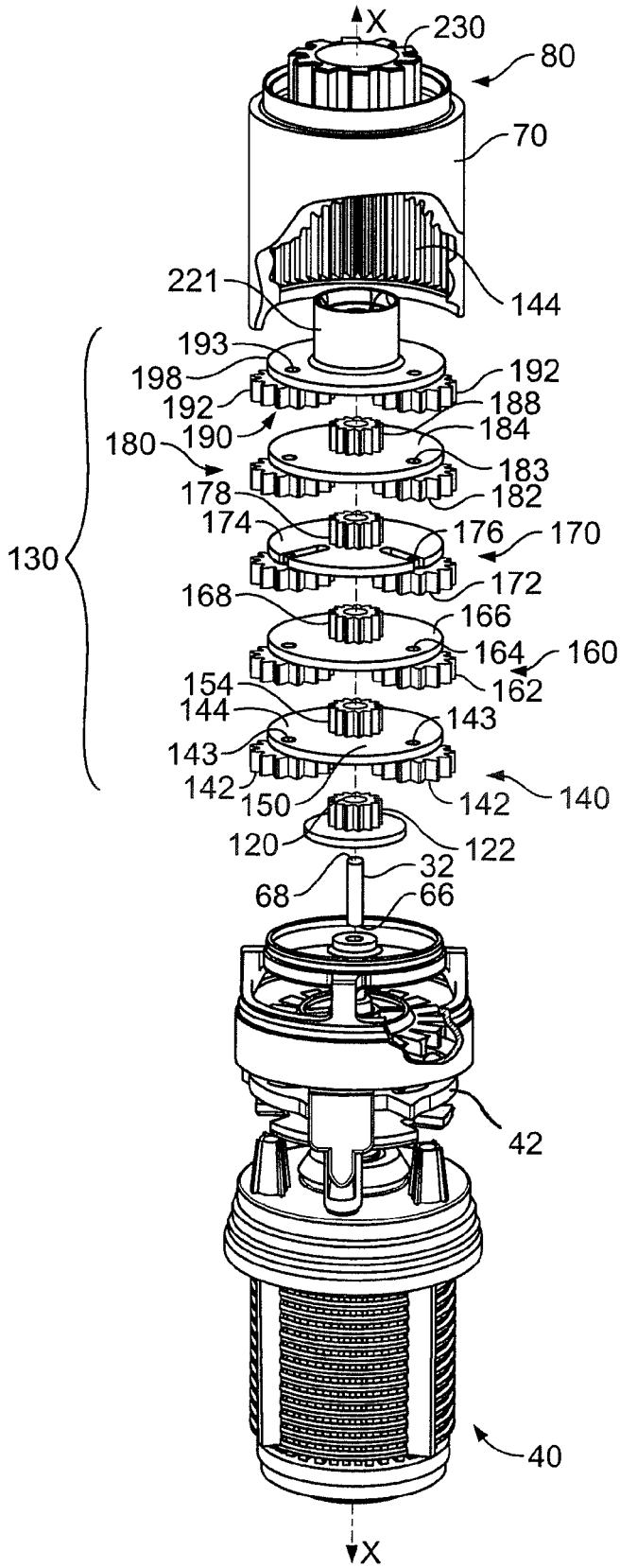
FIG. 4 is an exploded view of the drive mechanism of the sprinkler of FIG. 1.
Figure 5:
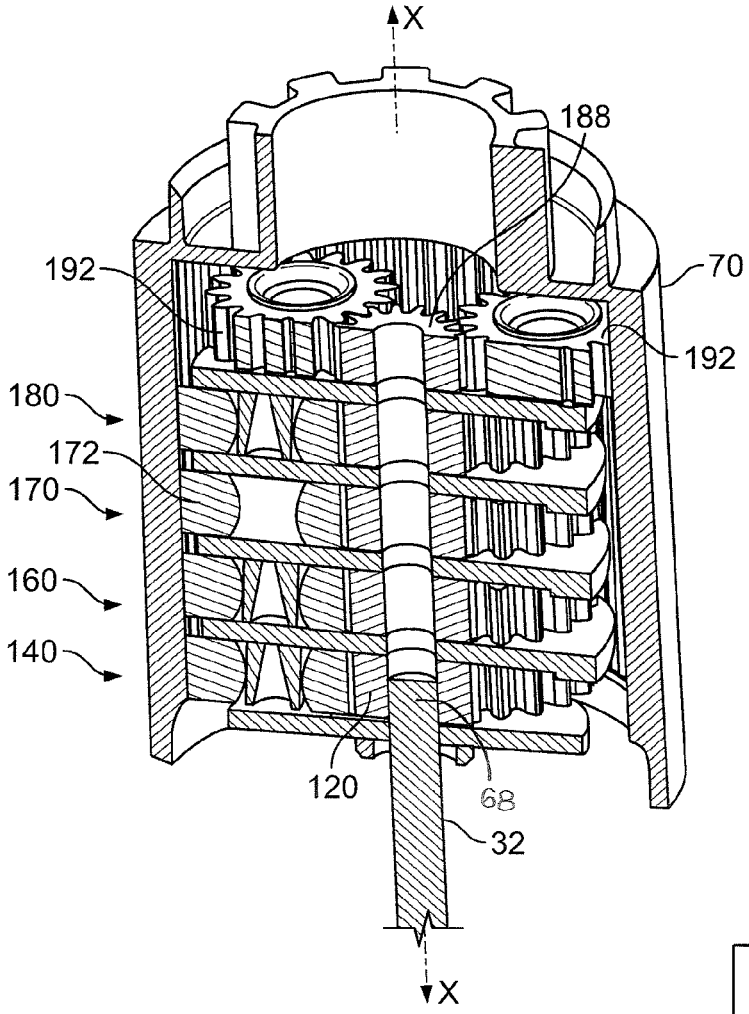
FIG. 5 is a cross-sectional view of the drive mechanism including carrier plates and planetary gears cooperating with the carrier plates of the sprinkler of FIG. 1 and having a carrier plate and hub thereof removed.
Figure 6:
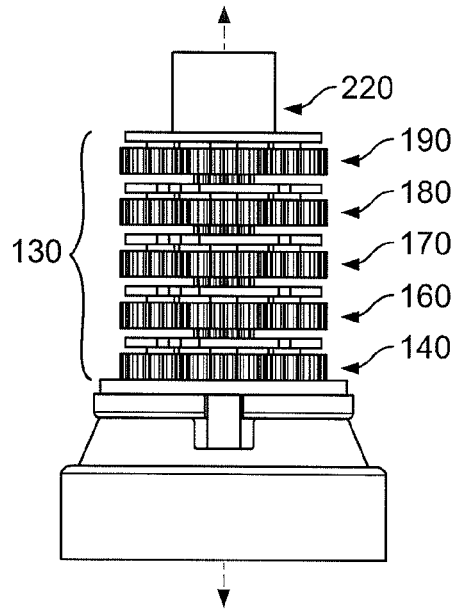
FIG. 6 is a side elevational view of the drive mechanism of the sprinkler of FIG. 1.

Referring initially to FIGS. 1, 2, and 4, a representative sprinkler 10 is depicted incorporating a variable-rate speed reduction drive mechanism 16 for providing power to rotate a sprinkler head 14 around a central axis X. The drive mechanism 16 is located within a movable housing 12 that shifts from a retracted position when the water source is shut off to an extended position when the water is turned on, as illustrated in FIG. 1.

The movable housing 12 is telescopically received within a generally fixed housing 20, and a spring (not shown) is provided for biasing the movable housing 12 downward to the retracted position in the housing 20. When the supply is activated, water flows into the fixed housing 20 from a source pipe 24 connected to the fixed housing 20, such as by a threaded connection (not shown). The force of the water overcomes the bias of the spring to telescopically extend the movable housing 12 from the fixed housing 20. As it flows through the sprinkler 10, the water drives a turbine 30 in a rotary fashion, as will be described in greater detail below.

The turbine 30 is secured to a turbine shaft 32 at a lower end such that the turbine 30 and the turbine shaft 32 rotate together. The turbine shaft 32 extends through and is connected to the drive mechanism 16. In this manner, the turbine shaft 32 communicates the rotational power generated by the water-driven turbine 30 to the drive mechanism 16. The drive mechanism 16 converts the high-velocity and low-torque rotation of the turbine shaft 32 and the turbine 30 into a velocity appropriate for rotating the sprinkler head 14 relative to both the movable and fixed housings 12, 20. During operation, the sprinkler head 14 rotates as water is emitted from a nozzle 36 in a generally radial direction.

Figure 3:
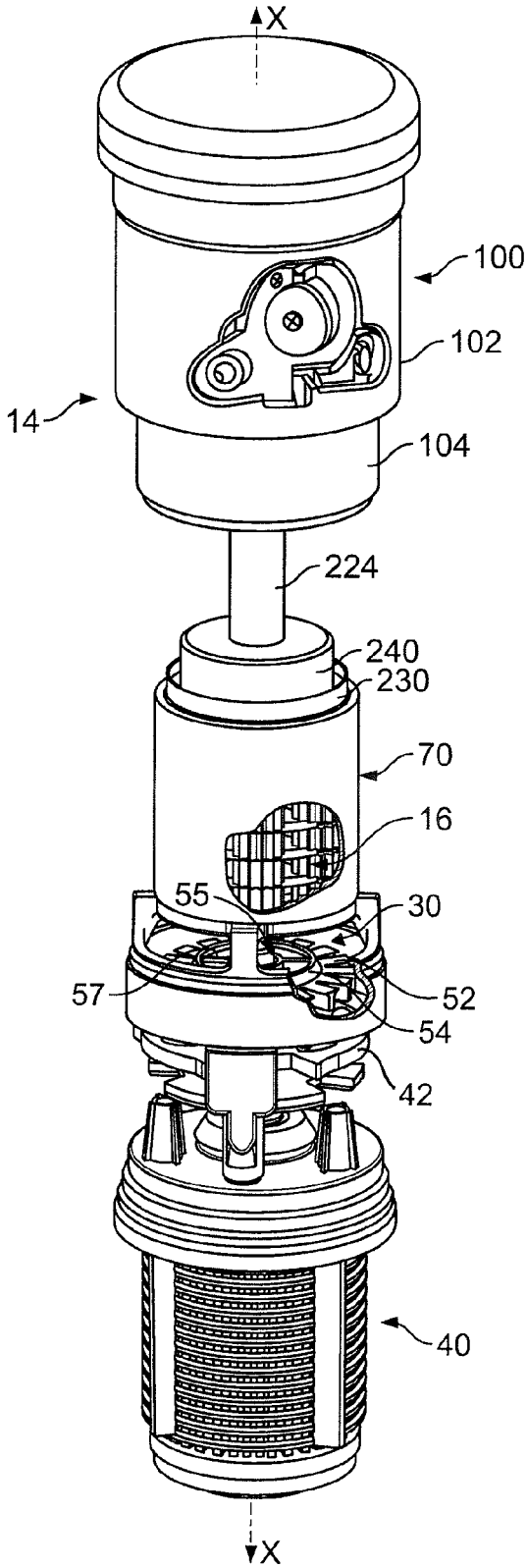
FIG. 3 is a perspective view of a filter screen, a stator module, the turbine, the drive mechanism and a drive housing therearound and partially cut away, a head drive shaft, and the head portion of the sprinkler of FIG. 1.

With reference to FIGS. 2 and 3, the sprinkler 10 may include a number of components beneficial to its operation and described in commonly assigned U.S. Pat. No. 6,732,950 B2, to Ingham, Jr. et al., which is incorporated by reference in its entirety herein. As water enters the movable housing 12, particulate matter is removed from the water stream by a filter unit 40 secured in a lower end of the movable housing 12. The water then flows upwardly and into contact with a trip plate 42 and a bypass valve 44.

The trip plate 42 cooperates with the turbine 30 to provide rotational power to the sprinkler head 14. The turbine 30 includes generally vertical vanes 52 radially oriented around a ring 54 connected to a hub 55 by spokes 57. Facing the vanes 52 is a plurality of trip plate openings 56 having angled deflectors 58 positioned adjacent thereto. The trip plate deflectors 58 include at least one directed to rotate the turbine 30 in one direction and at least another directed to rotate the turbine 30 in the other direction. A reverse mechanism 90, as described further below, shifts the trip plate 56 between the two different water providing directions to change the direction of rotation of the sprinkler head 14.

Water flows upwardly from the filter 40, into the trip plate 42, and through the openings 56. The water forms jet streams through the openings 56, and the deflectors 58 direct the water at an angle upwardly against the vanes 52, thereby imparting a portion of the kinetic energy of the water to the turbine 30. This energy rotationally drives the turbine 30 at a velocity of approximately 1000-2000 revolutions per minute. In the event the pressure from the water flow below the trip plate is above a predetermined level, the bypass valve 44 opens to permit a portion of the water to flow around the trip plate 42 without striking the vanes 52. Instead, the water through the bypass valve 44 flows around the turbine 30 and outside of the vanes 52.

The bypass valve assembly 44 includes a bypass valve opening 50 defined by a bypass valve seat plate 51 and a spring 48 for biasing a valve plunger 46 toward the bypass valve opening 50. When the pressure differential between above and below the bypass valve opening 50 is sufficient to overcome the bias of the spring 48, the valve plunger 46 shifts away from the bypass valve opening 50 to permit water to pass through the bypass valve opening 50 and around the trip plate 42 and the turbine 30.

As noted above, the turbine 30 receives energy from the water flow for driving the drive mechanism 16. The hub 55 of the turbine 30 is generally secured to the turbine shaft 32 at a lower segment 66 such that the turbine 30 and turbine shaft 32 rotate together. A second segment 68 of the turbine shaft 32 is engaged with the drive mechanism 16 to communicate the rotational energy of the turbine shaft 32 and the turbine 30 to the drive mechanism 16.

Once it has flowed beyond the turbine 30, the water continues upwardly through the movable housing 12, around the drive mechanism 16, and into the sprinkler head 14 for emission therefrom. As can be seen, the drive mechanism 16 is axially aligned with the turbine 30, as well as the movable housing 12 in general. The drive mechanism 16 includes a generally cylindrical drive housing 70. It is preferred that a small amount of water be permitted to enter the drive housing 70 for lubricating the drive mechanism 16. It also is preferred that the water entering the drive housing 70 be filtered to prevent small debris from entering the drive housing 70 and damaging the drive mechanism 16. The filtering can be accomplished by using small holes through the drive housing wall to allow water to enter the drive housing.

Other than the small amount flowing into the drive housing 16, the water flows from the turbine 30, around a lower side 72 and circumferential side 74 of the drive housing 70, and through a cavity 76 formed between the drive housing 70 and an interior surface 78 of the movable housing 12. The water then flows around a top side 80 of the drive housing 70, and upwardly through a flow passage 82 communicating with a lower chamber 84 of the sprinkler head 14. The water delivered into the lower chamber 84 is subsequently emitted from the sprinkler head 14, by way of the nozzle 36.

As noted, the sprinkler head 14 rotates relative to the movable and fixed housings 12, 20 to deliver water in a radial manner therefrom. In the depicted form of the sprinkler 10, the sprinkler head 14 includes a reverse mechanism 90. Towards this end, the sprinkler head 14 includes an upper chamber 92 in which the reverse mechanism 90 is located. The reverse mechanism 90 is connected to the lower trip plate 42 through an elongated trip shaft 41. The shaft 41 rotates the trip plate 42 to change the deflectors to provide a different flow direction at the turbine 30 to change the direction of one sprinkler head 14. The sprinkler head 14 includes a housing 100 having an upper cylindrical body portion 102 and a lower cylindrical skirt portion 104. The upper portion 102 has a bottom annular edge 106 facing an upper annular edge 108 formed on the movable housing 12. A seal member 110, such as an O-ring, is positioned between the body bottom edge 106 and the movable housing upper edge 108 to minimize passage of foreign matter into the sprinkler 10. Leakage is restricted by a seal 112, such as an O-ring or a T-ring, positioned between a bottom annular edge 114 of the skirt portion 104 and an inner surface 116 formed on an annular ledge 118 of the movable housing 12, as can be seen in FIG. 2.

The rotation of the sprinkler head 14 is driven by the variable-rate speed reducing drive mechanism 16. With reference to FIG. 4, the turbine shaft 32 is aligned with the central axis X, and the axle second segment 68 engages a main drive gear 120 and is fixedly mounted thereto such that the turbine shaft 32 and the main drive gear 120 rotate together around the axis X. The drive gear 120 includes external gear teeth 122 for communicating with a series of gear modules 130. As explained in more detail below, each gear module 140, 160, 170, 180, and 190 of the series of modules 130 includes at least one and preferably three identical planet gears cooperating via an axle with a carrier plate which rotates around the axis X. The planet gears are arranged equidistant from each other about the axis X.

The first gear module 140 includes three identical planet gears 142 cooperating via an axle 143 with a carrier plate 150. The axle 143 secures the planet gear 142 to the carrier plate and permits rotation of the planet gear 142 relative to the carrier plate 150. More specifically, the drive gear 120 is received between and in geared relationship with the planet gears 142 of the first gear module 140. The planet gears 142 are further in geared relationship with an internal splined or gear-toothed surface 144 of the drive housing 70, such that the drive housing 70 forms a ring gear. As the drive gear 120 rotates, its teeth 122 cooperate with the planet gears 142, thereby driving the planet gears 142 around the drive housing inner surface 144. The first carrier plate 150 rotates at a rate equal to the rate at which the planet gears 142 travel around the inner ring gear surface 144 and around the X axis.

The drive gear 120 has fewer teeth 122 than are located on each of the generally identical planet gears 142. Accordingly, a single rotation of the drive gear 120 effects less than a full rotation of each planet gear 142, resulting in a gear reduction. A further gear reduction is provided between the planet gears 142 and the ring gear surface 144. The ring gear surface 144 has many more teeth than each of the planet gears 142 such that a single rotation of the planet gear 142 around its axle 143 effects less than a full rotation around the ring gear surface 144. Therefore, multiple rotations of the planet gear 142 are required to complete a rotation around the inner surface 144. Accordingly, the relative gearing between the planet gear 142 and the ring gear surface 144 effect a further gear reduction.

The first carrier plate 150 transmits the reduced speed rotation to a top drive gear 154 fixedly secured to, and preferably integral with, the plate portion 150. The top drive gear 154 is axially aligned along the central longitudinal axis X so that its rotation is coaxial with the carrier plate 150 and with the turbine shaft 32.

As mentioned above, the drive mechanism 16 includes a series of gear modules 130, including modules 140, 160, 170, 180 and 190, generally providing a similar gear reduction. The top drive gear 154 of the first gear module 140 is generally identical in size and teeth to the main drive gear 120, discussed above. As such, the top drive gear 154 cooperates with a second gear module 160 generally identical to the first gear module 140 and having planet gears 162 rotating around axles 164 secured to a carrier plate 166 having a top drive gear 168 rotating co-axially with the turbine shaft 32.

The top drive gear 168 of the second carrier plate 166 then cooperates with planet gears 172 attached to a third carrier plate 174 of a third gear module 170. The third carrier plate 174 rotates a top drive gear 178, which cooperates, in turn, with planet gears 182 of a fourth gear module 180. The planet gears 182 of the fourth gear module 180 are attached to a fourth carrier plate 184 having a top drive gear 188. The drive gear 188 cooperates with planet gears 192 of a fifth gear module 190 having a fifth carrier plate 198 with an output hub 221 mounted thereon.

The planet gears 142, 162, 172, 182, and 192 of each gear module 140, 160, 170, 180, 190 further cooperate with the ring gear surface 144. As each gear module 140, 160, 170, 180, and 190 provides the described gear reduction, the input speed from the turbine shaft 32 is reduced, for example, from the above-mentioned 1000-2000 revolutions per minute to an output speed at the output hub 220 of approximately ⅓ of a revolution per minute. It should be noted that the gear reduction, and speed reduction, is dependent on the teeth and size of the gears, and may easily be selectively provided as desired.

As stated, the drive mechanism 16 provides a variable rate of rotation, the rotation being communicated via the output hub 220. More specifically, one of the gear modules in the module series 130 provides a variable rate of rotation. In the preferred embodiment, the carrier plates 150, 166, and 184 for the first, second, and fourth gear modules 140, 160, 180, respectively, are generally identical, as are their respective top drive gears 154, 168, 188, while the fifth gear module 190 includes the output hub 220. In addition, the planet gears 142, 162, 182, and 192 for the first, second, fourth and fifth gear modules 140, 160, 180, 190 are generally identical.

Figure 7:
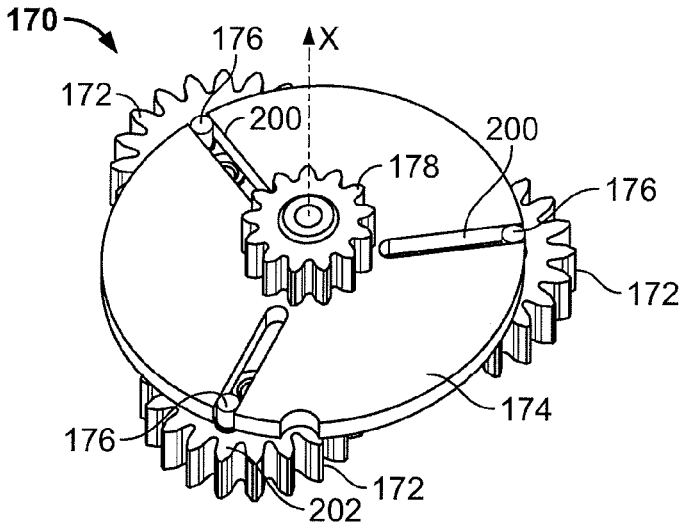
FIG. 7 is a perspective view of a slotted carrier plate and planetary gears of the drive mechanism of FIG. 1, the gears having eccentrically positioned posts for cooperating with the slots of the carrier plate.
Figure 8:
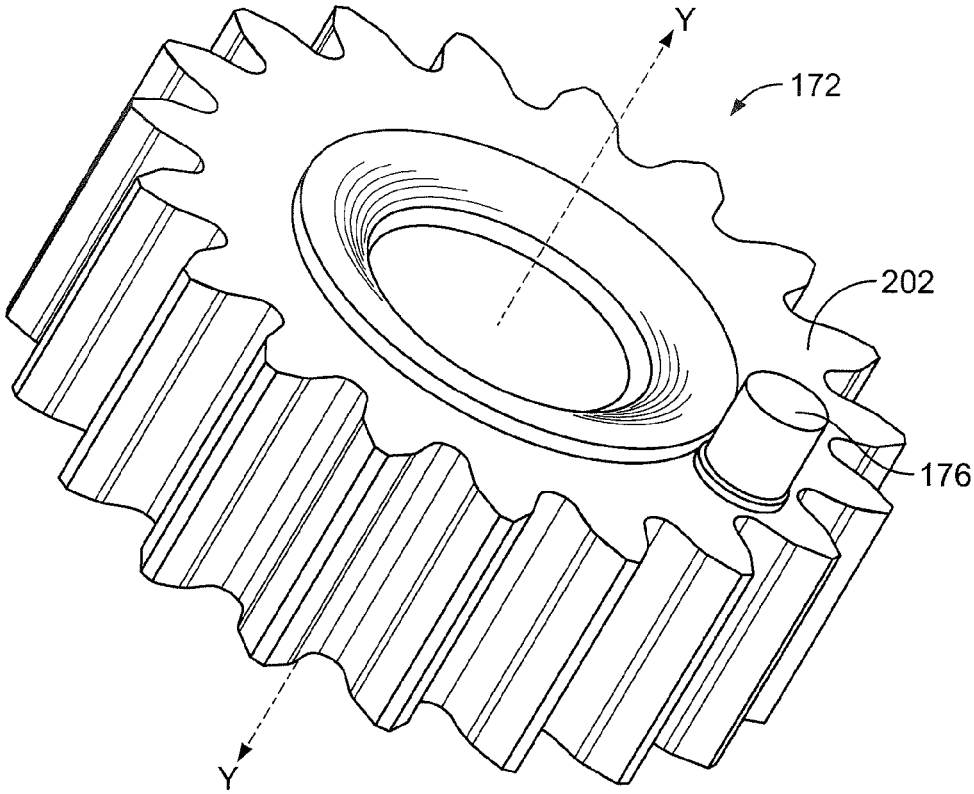
FIG. 8 is a perspective view of one of the planetary gears of FIG. 7 including an eccentrically positioned post.
Figure 9:
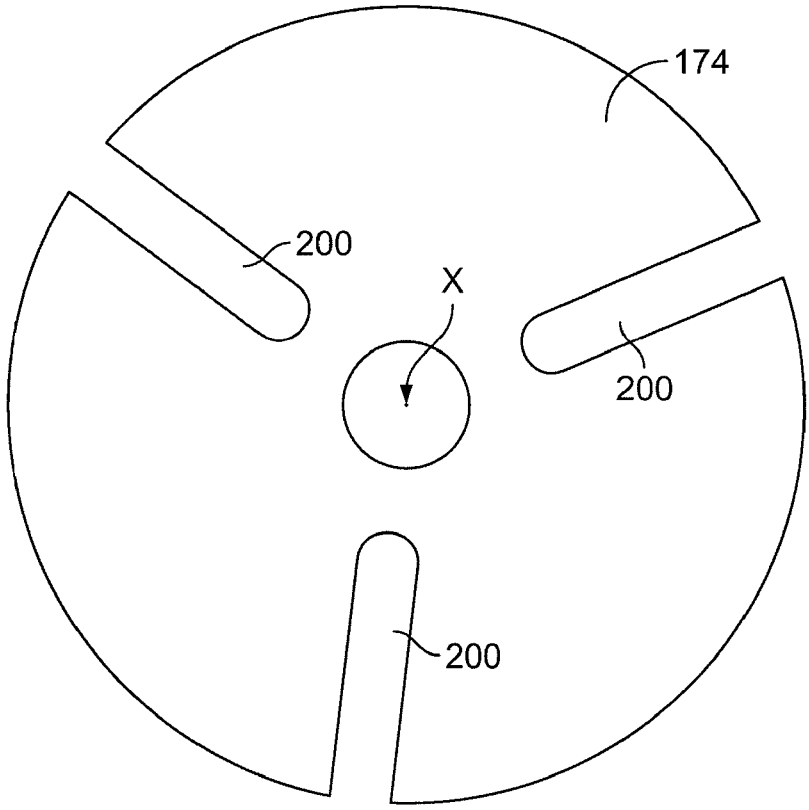
FIG. 9 is a top plan view of the slotted carrier plate of FIG. 7.
Figure 10:
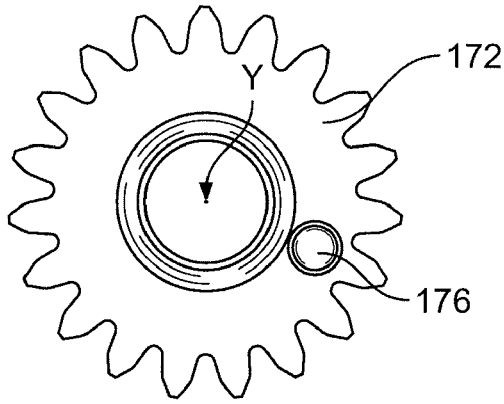
FIG. 10 is a top plan view of the planetary gear of FIG. 8.

The third gear module 170 has modified planet gears 172 and a modified carrier plate 174 to provide the desired intermittent or variable rotation watering capability. More specifically, the third gear module 170 receives a generally constant input rate of rotation and produces a variable rate of rotation as an output. As best illustrated in FIG. 7, the third carrier plate 174 defines at least one and preferably three radially extending slots 200. The third set of planet gears 172 are sized and geared generally identically to the other planet gears 142, 162, 182, and 192. However, the planet gears 172 are provided with a fixed post 176, thereby omitting axles 143, 164, 183, 193 utilized with the other planet gears 142, 162, 182, and 192. The post 176 is eccentrically positioned relative to the axis Y on a top surface 202 of each of the planet gears 172 and is aligned parallel to the central axis Y of rotation of each of the planet gears 172. Each planet gear 172 cooperates with the top drive gear 168 of the second gear module 160 and with the inner ring surface 144, as described above.

The eccentric posts 176 of the planet gears 172 drive the carrier plate 174 with a varying rate of rotation. Each post 176 is received in a respective plate slot 200 and is generally free to move therealong. In comparison, the axle 143 for the planet gears 132 of the module 130, around which each planet gear 132 rotates, is centrally positioned on the axis of rotation of the planet gear 132. Accordingly, the axle 143 remains at a constant distance from the ring gear surface 144. As the planet gear 132 rotates, the axle 143 follows a generally constant circular path within the ring gear surface 144. This path is generally a constant distance from the axis X to the position of the axle 143 on the carrier plate 134. The planet gear 132 rotates around the axle 143 at a generally constant velocity, the axle 143 itself will follow its path with a generally constant velocity. The carrier plate 134 rotates based on being directed around by the axles 143 secured thereto, thus being a constant rate of rotation for the planet gears 132. This is the same for each of the modules 140, 160, 180, and 190, but not for the modified module 170.

The slotted carrier plate 174 takes its variable rate of rotation from the rate of angular change in position for the posts 176. As noted, the fixed axles 143, 164, 183, and 193 have a fixed position relative to their respective carrier plate 150, 166, 184, 198, and along the center of rotation of their respective planet gears 142, 162, 182, and 192, so that their axles 143, 164, 183, and 193 follow a circular path with a generally constant distance from the axis X. In contrast, the posts 176 are not fixed relative to the slotted carrier plate 174, instead being permitted to move along the slots 200, and do not follow a circular path. In addition, the rate of rotation for the slotted carrier plate 174 is related to not only the gear ratio between the ring gear 144 and the planet gear 172, but is also related to the position of the post 176 in the slot relative to the axis X.

Figure 11:
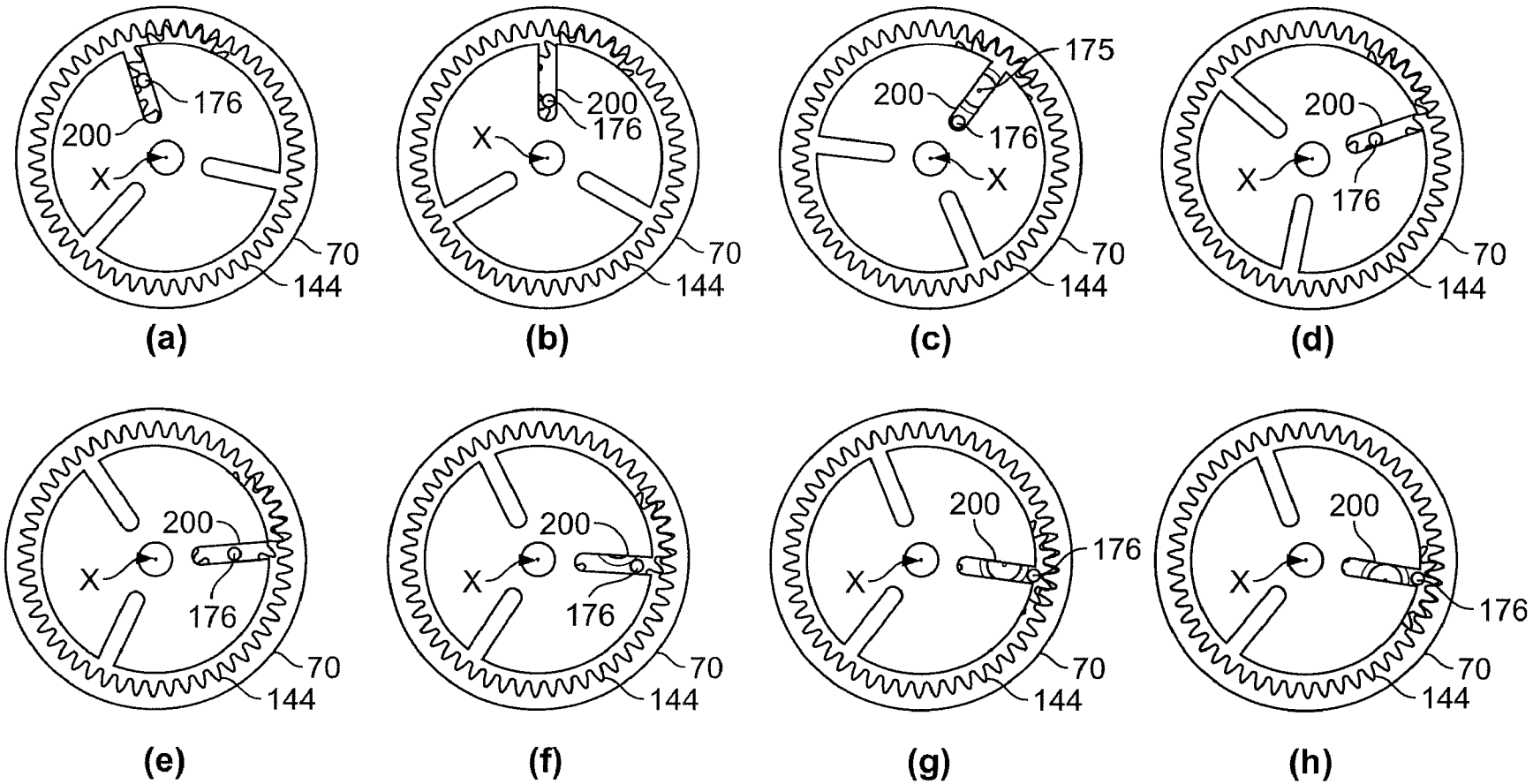
FIGS. 11*a*-11*h* is a series of top plan views showing relative positions of the slotted carrier plate and planetary gears of FIG. 7 and a ring gear surface on the interior of drive housing.
Figure 12:
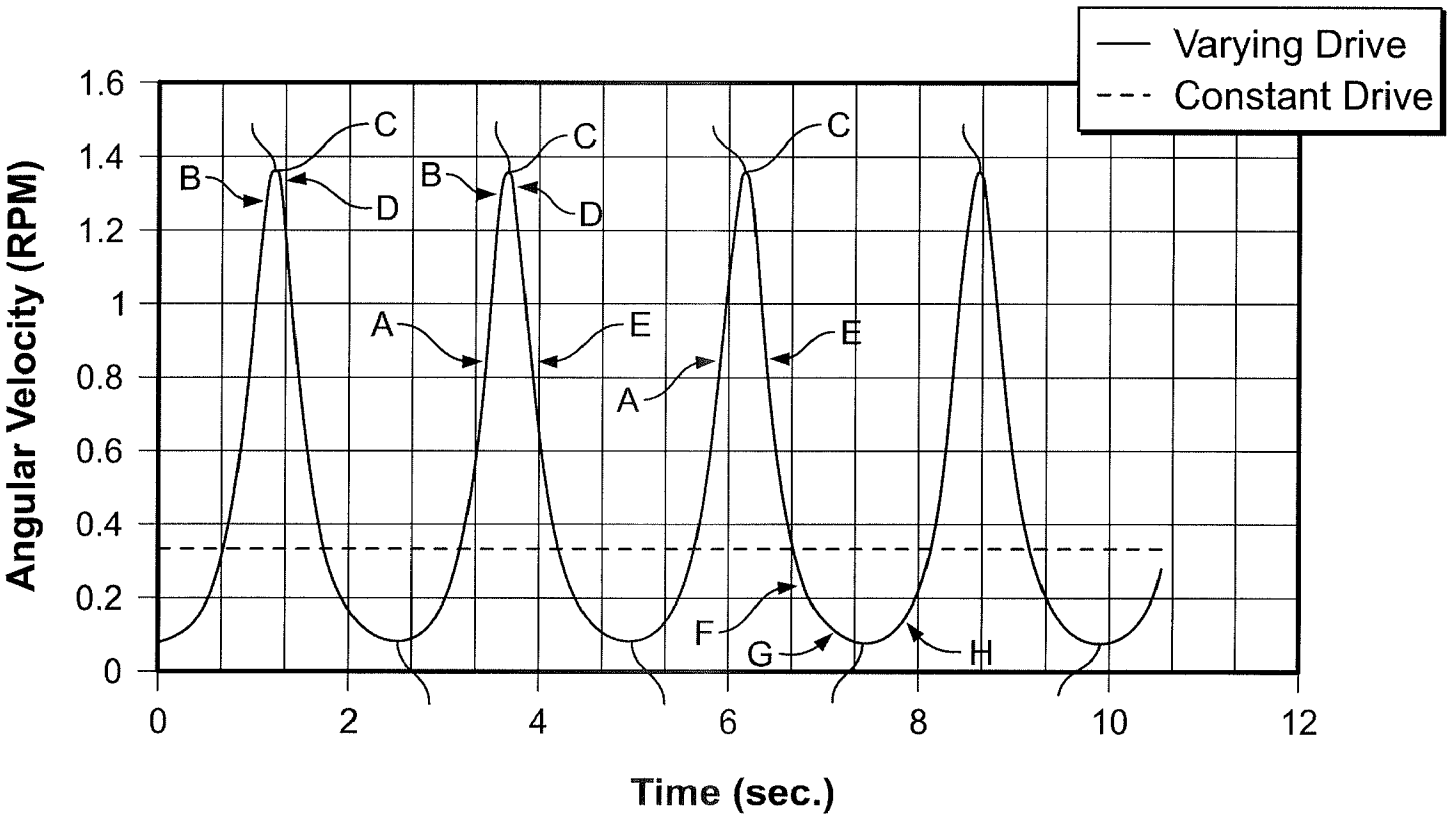
FIG. 12 is a plot of angular velocity versus time for the drive mechanism including the slotted carrier plate of the sprinkler of FIG. 1, and for a drive mechanism of the prior art.
Figure 13:
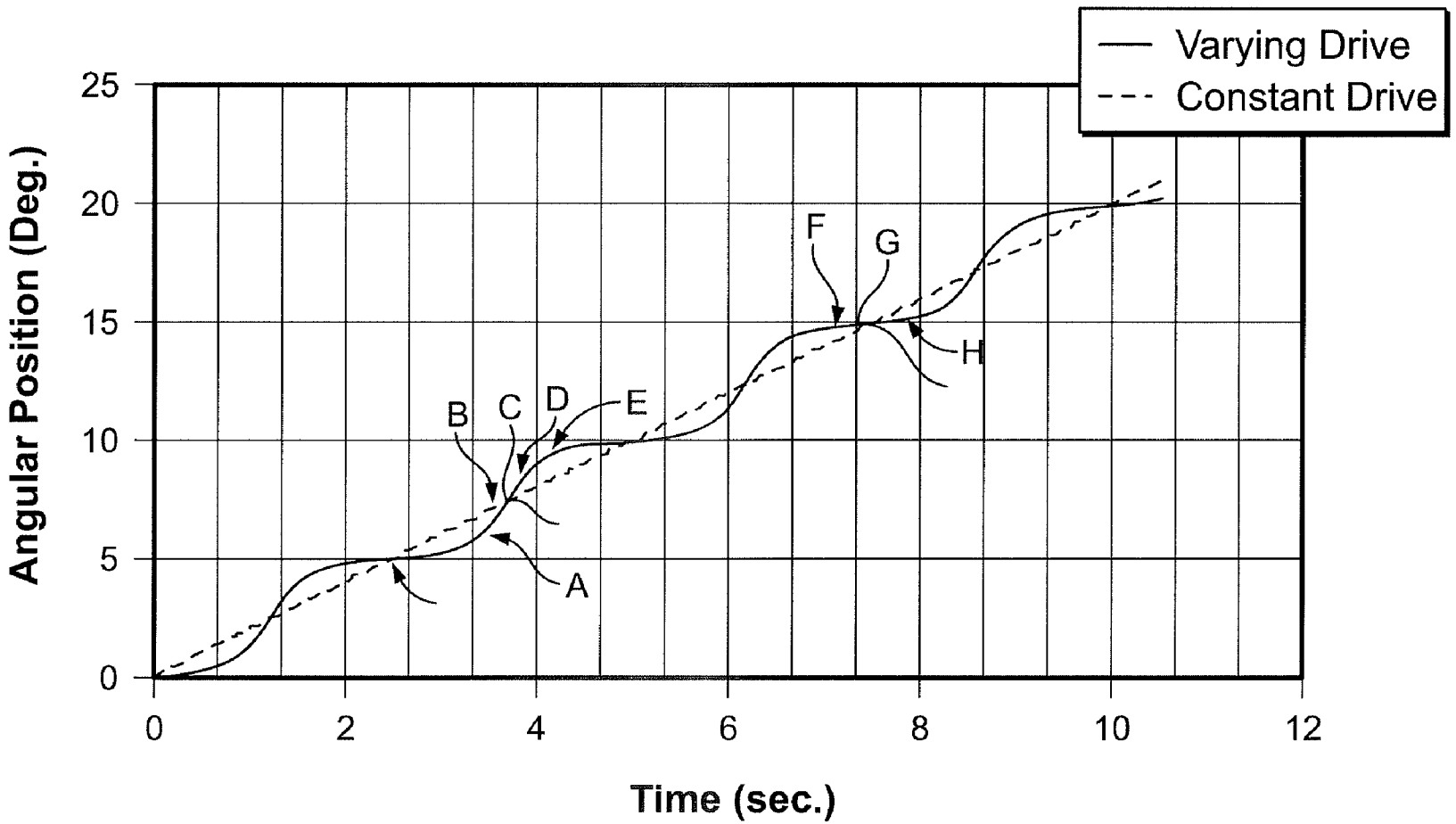
FIG. 13 is a plot of angular position versus time for the drive mechanism including the slotted carrier plate of the sprinkler of FIG. 1, and for a drive mechanism of the prior art.

With reference to FIGS. 11-13, the post 176 moves towards and away from the axis X to drive the carrier plate 174 with a rotation equal to the change in radial angular position (angular velocity) relative to the axis X traveled by the post 176. As the planet gear 172 has a constant rotational rate, the post 176 has a constant rate of change of angular position (angular velocity) about its axis Y. When the post 176 is positioned midway along the slot 200, the translation of the post 176 is generally in the radial direction relative to the axis X such that the angular change relative thereto is relatively constant. However, as the post 176 approaches the central axis X, translation achieved by post 176 effects a greater angular change relative to the axis X such that the carrier plate 174 is accelerated. Conversely, as the post 176 moves away from a position close to the central axis X, the carrier plate is decelerated. Furthermore, the carrier plate 174 continues to decelerate as the post 176 approaches a position close to the ring gear surface 144. Once the post 176 has begun to return towards the central axis X along the slot 200, the carrier plate 174 is once again accelerated.

In FIGS. 12 and 13, the post 176 being positioned at its minimal radial distance from the axis X is represented by Σ, and the post 176 being positioned at its maximum radial distance is represented by Φ.

The positions and velocity for the carrier plate 174 can be seen by comparing FIG. 11 with FIGS. 12 and 13. FIG. 11*a* shows the post 176 positioned approximately midway along the slot 200. At this position, the angular acceleration of the post 176 is relatively constant such that its angular velocity increases somewhat linearly, represented generally by A in the plots of FIGS. 12 and 13. As the post 176 travels from the position of FIG. 11*a* to a position of FIG. 11*b*, the post 176 moves closer to the central axis X, the plate 174 rotates around the axis X faster than the planet gear 172 rotates about its center of rotation axis Y of the planet gear 172, as the slot 200 moves closer to the center of rotation axis Y. In doing so, the post 176 moving inward increases the angular velocity of the carrier plate 174 because the angular velocity of the post 176 about the central axis X also increases, as represented by B in the plots of FIGS. 12 and 13. As the post 176 and the axis Y of the center of rotation of the planet gear 172 (FIG. 11*c*) become aligned with the slot 200, the angular velocity of the post 176 approaches its maximum, as represented by C (as well as L) in FIGS. 12 and 13. Further rotation of the planet gear 172 moves the slot 200 away from the center of rotation axis Y (FIG. 11*d*), and the angular velocity decreases, as represented by D in FIGS. 12 and 13. The carrier plate 174 also slows with an angular deceleration equal in magnitude to the acceleration through the portion of B in FIGS. 12 and 13.

As the post 176 moves to the position represented by FIG. 11*e* and represented as E in FIGS. 12 and 13, the angular velocity of the plate 174 decreases. In positions represented by F, G, and H of FIGS. 12 and 13 and shown in FIGS. 11*f*-11*h*, the angular translation of the post 176 about the Y-axis effects a relatively small angular velocity for the carrier plate 174, approaching though not entirely reaching zero, as represented by Φ in FIGS. 12 and 13.

Accordingly, the rate of rotation of the carrier plate 174, and its top drive gear 178, is varied in relation to the rate of rotation of the planet gears 172. Therefore, when the planet gears 172 receive a constant rotational velocity, the carrier plate 176 is provided with a variable rotation rate. For the drive mechanism 16, a constant rate of rotation is provided by the main drive gear 120, reduced by the first gear module 140. This is communicated to the second gear module 160, which, in turn, reduces the rate of rotation and communicates the reduced rate to the third gear module 170. The third gear module 170 reduces the average rate of rotation, varies the rate through the slotted carrier plate 174 and the planet gears 172, and outputs this to the top drive gear 178, which, in turn, is transmitted to the fourth and fifth gear modules 180, 190 for further reduction. Ultimately, the output hub 220 communicates the reduced and variable rotation to the sprinkler head 14.

Thus, the sprinkler 10 provided with a generally constant water flow rate includes the sprinkler head 14 rotating with the variable rate. The output hub 220 communicates the varying reduced speed rotation from the drive mechanism 16 to the sprinkler head 14. The output hub 220 includes a cylindrical shell 221 rising along the axis X from the carrier plate 198 of the fifth gear module 190. The output hub 220 further includes a centrally formed non-circular socket 222 open upwardly so as to receive a drive shaft 224 (FIGS. 2 and 3) secured to the sprinkler head 14. The drive shaft 224 has a non-circular lower portion 226 to matingly cooperate with the socket 222 such that the drive shaft 224 rotates with the output hub 220.

The housing 70 is generally sealed from the flow of water. With reference to FIGS. 2-4, the top side 80 of the housing 70 includes an axially extending splined ring 230. A cap 240 is positioned around the drive shaft 224 and has splines for mating the splines of the ring 230. A seal may be located between the drive shaft 224 and the cap 240, or between the drive shaft 224 and the output hub 220.

While the invention has been described with respect to specific examples, including presently preferred modes of carrying out the invention, those skilled in the art will appreciate that there are numerous variations and permutations of the above described apparatuses and methods that fall within the spirit and scope of the invention as set forth in the appended claims.

What is claimed is:

1. A rotary drive motor for a sprinkler comprising:

a turbine being capable of rotating at a substantially constant rate of rotation in response to water flow; and a transmission disposed in the housing and in communication with the turbine to convert the substantially constant rate rotation of the turbine as an input to a generally variable rotation rate of rotation output, the transmission having a first gear module comprising:

a substantially constant drive gear rotated in response to the turbine;

at least one planetary gear in engagement with and rotated by the substantially constant drive gear;

a rotatable carrier plate having a variable rate of rotation about a central axis thereof and configured to be rotated about the central axis by the rotation of the at least one planetary gear; and the at least one planetary gear having a connection to the rotatable carrier plate that is arranged and configured to slide in a radial direction relative to the central axis of rotation such that when the connection is at a position closest to the central axis of rotation the rotatable carrier plate provides a maximum rotational speed output and when the connection is at a position furthest from the central axis of rotation the rotatable carrier plate provides a minimum rotational speed output.

2. A rotary drive motor in accordance with claim 1 wherein the transmission further includes a second gear module that reduces the substantially constant rate of rotation to a second lower substantially constant rate of rotation.

3. A rotary drive motor in accordance with claim 2 wherein the first and second gear modules are in a stacked arrangement.

4. A rotary drive motor for a sprinkler comprising:

a turbine being capable of rotating at a substantially constant rate of rotation in response to water flow; and a transmission disposed in the housing and in communication with the turbine to convert the substantially constant rate rotation of the turbine as an input to a generally variable rotation rate of rotation output, the transmission having a first gear module comprising:

a substantially constant drive gear rotated in response to the turbine;

at least one planetary gear in engagement with and rotated by the substantially constant drive gear;

a rotatable carrier plate having a central axis of rotation and being rotated by the at least one planetary gear;

the at least one planetary gear having a radially shifting connection to the rotatable carrier plate relative to the central axis of rotation such that at a position closest to the central axis of rotation the rotatable carrier plate provides a maximum rotational speed output and a position furthest from the central axis of rotation the rotatable carrier plate provides a minimum rotational speed output; and wherein the radially shifting connection includes a radial slot defined by the rotatable carrier plate and the at least one planetary gear having a post that slides radially in the slot during operation.

5. A rotary drive motor in accordance with claim 4 wherein the at least one planetary gear includes a center axis of rotation and the post extends from the at least one planetary gear at a location spaced from the center axis of rotation.

6. A rotary drive motor in accordance with claim 5 wherein the rotatable carrier plate includes a gear portion and a carrier portion, and the carrier portion defines the radial slot.

7. A rotary drive motor in accordance with claim 6 wherein the first module includes three planetary gears, each planetary gear having a post, and the carrier portion of the rotatable carrier plate defining a radial slot for each post.

8. A rotary sprinkler comprising:

a housing defining a passage for water flow therethrough;

a sprinkler head rotatably supported by the housing;

a turbine disposed in the housing and in fluid communication with at least a portion of the water flow which causes the turbine to rotate at a substantially constant rate of rotation; and a transmission disposed in the housing and in communication with the turbine and the sprinkler head to convert the substantially constant rate rotation of the turbine to a generally variable rotation rate of rotation for the sprinkler head, the transmission having a first gear module comprising:

a substantially constant drive gear rotated in response to the turbine;

at least one planetary gear in engagement and rotated by the substantially constant drive gear; and a rotatable carrier plate having a central axis of rotation and being rotated by the at least one planetary gear, the at least one planetary gear having a connection to the rotatable carrier plate that is arranged and configured to shift in a radial direction relative to the central axis of rotation such that at a position closest to the central axis of rotation the rotatable carrier plate provides a maximum rotational speed for the sprinkler head and at a position furthest from the central axis of rotation the rotatable carrier plate provides a minimum rotational speed for the sprinkler head.

9. A rotary sprinkler in accordance with claim 8 wherein the transmission further includes a second gear module that reduces the substantially constant rate of rotation to a second lower substantially constant rate of rotation.

10. A rotary sprinkler in accordance with claim 9 wherein the first and second gear modules are in a stacked arrangement.

11. A sprinkler in accordance with claim 9 wherein the radially shifting connection includes a radial slot defined by that the rotatable carrier plate, and the at least one planetary gear has a post that slides radially in the slot during operation.

12. A rotary sprinkler in accordance with claim 11 wherein the at least one planetary gear includes a center axis of rotation and the post extends from the at least one planetary gear at a location spaced from the center axis of rotation.

13. A rotary drive motor in accordance with claim 11 wherein the rotatable carrier plate includes a gear portion and a carrier portion, and the carrier portion defines the radial slot.

14. A rotary drive motor in accordance with claim 13 wherein the first module includes three planetary gears, each planetary gear having a post, and the carrier portion of the rotatable carrier plate defines a radial slot for each post.

* * * * *